US010180020B2

(12) United States Patent
Mittelbach

(10) Patent No.: US 10,180,020 B2
(45) Date of Patent: Jan. 15, 2019

(54) MOTOR VEHICLE DOOR LOCK

(71) Applicant: Kiekert Aktiengesellschaft, Heiligenhaus (DE)

(72) Inventor: Stephan Mittelbach, Velbert (DE)

(73) Assignee: Kiekert Aktiengesellschaft, Heiligenhaus (DE)

( * ) Notice: Subject to any disclaimer, the term of this patent is extended or adjusted under 35 U.S.C. 154(b) by 570 days.

(21) Appl. No.: 14/429,802

(22) PCT Filed: Sep. 14, 2013

(86) PCT No.: PCT/DE2013/000529
§ 371 (c)(1),
(2) Date: Apr. 20, 2015

(87) PCT Pub. No.: WO2014/044241
PCT Pub. Date: Mar. 27, 2014

(65) Prior Publication Data

US 2015/0240538 A1 Aug. 27, 2015

(30) Foreign Application Priority Data

Sep. 20, 2012 (DE) ..... 20 2012 103 608 U

(51) Int. Cl.

| | |
|---|---|
| ***E05B 85/24*** | (2014.01) |
| ***E05B 77/34*** | (2014.01) |
| ***E05B 85/02*** | (2014.01) |
| ***E05B 85/26*** | (2014.01) |
| *E05B 15/16* | (2006.01) |

(52) U.S. Cl.
CPC ..... *E05B 85/243* (2013.01); *E05B 77/34* (2013.01); *E05B 85/02* (2013.01); *E05B 85/26* (2013.01); *E05B 2015/1664* (2013.01); *Y10T 292/1075* (2015.04)

(58) Field of Classification Search
USPC ..... 292/195
See application file for complete search history.

(56) References Cited

U.S. PATENT DOCUMENTS

| | | | | |
|---|---|---|---|---|
| 5,678,869 | A * | 10/1997 | Yoshikuwa | E05B 81/66 292/216 |
| 5,709,420 | A * | 1/1998 | Umino | E05B 83/36 292/216 |
| 6,249,983 | B1 * | 6/2001 | Wright | G01C 9/26 33/286 |

FOREIGN PATENT DOCUMENTS

| | | | |
|---|---|---|---|
| DE | 102004001988 | A1 | 8/2005 |
| DE | 102009042630 | A1 | 3/2011 |
| EP | 0894926 | A1 | 2/1999 |

(Continued)

OTHER PUBLICATIONS

Machine Translation of DE102004001988A1 on Apr. 3, 2015 by Lexis Nexis Total Patent.

(Continued)

*Primary Examiner* — Mark A Williams
(74) *Attorney, Agent, or Firm* — Woodard, Emhardt, Moriarty, McNett & Henry LLP

(57) ABSTRACT

The invention relates to a motor vehicle door lock, having at least one housing (1) made of plastics material and having a locking mechanism (3, 4) comprising substantially a rotary latch (3) and a pawl (4), wherein the pawl (4) is mounted inside the housing (1) and the rotary latch (3) is mounted on the outside of the housing (1).

19 Claims, 2 Drawing Sheets

(56) References Cited

FOREIGN PATENT DOCUMENTS

| | | |
|---|---|---|
| GB | 1300321 | 12/1972 |
| WO | WO 2011/102057 A1 | 8/2011 |

OTHER PUBLICATIONS

Machine Translation of DE102009042630A1 on Apr. 3, 2015 by Lexis Nexis Total Patent.
Machine Translation of WO2011/1102057A1 on Apr. 3, 2015 by Lexis Nexis Total Patent.

* cited by examiner

MOTOR VEHICLE DOOR LOCK

CROSS-REFERENCE TO RELATED APPLICATIONS

This application is the U.S. national stage application of International Patent Application No. PCT/DE2013/000529, filed Sep. 14, 2013, which claims priority of German Application No. 20 2012 103 608.8, filed Sep. 20, 2012, which are both hereby incorporated by reference.

BACKGROUND

The invention relates to a motor vehicle door lock, having at least one housing made of plastic and having a locking mechanism comprising substantially a rotary latch and pawl.

Such motor vehicle door locks are known from practical applications and are, for instance, disclosed in the generic DE 10 2009 042 630 A1. This document contains an explosive view of the motor vehicle door lock. In this case, the motor vehicle door lock contains the already said plastic housing as well as a metal lock case accommodates the locking mechanism comprising substantially a rotary latch and pawl. The metal lock case is generally required to be able to absorb forces acting on the locking mechanism and also, in particular, in the event of an accident. This has generally proven to be successful.

Actually, the locking mechanism of the motor vehicle door lock typically cooperates with a locking bolt on, for instance, a B column of a motor vehicle body. In most cases, the motor vehicle door lock is arranged on the inside of a motor vehicle door. In this way, an overall motor vehicle door lock is provided. As disclosed in the state of the art of DE 10 2009 042 630 A1 and shown in the drawing, the plastic housing consists in most cases of two parts and contains a housing hood closing off the housing.

As a result, motor vehicle door locks based on the state of the art regularly contain said metal lock case and the two-part housing with, for instance, a bottom and a top housing part or the actual housing or a housing shell and a housing hood. The result is a relative complex and, in particular, costly arrangement consisting at least of three structural elements (lock case, bottom housing section or housing and top housing section).

In addition, the rotary latch must be arranged in the area of the inlet slot for engagement with the locking bolt, thus requiring an opening in the motor vehicle door lock. Dirt or also moisture can enter through this opening. Although seals are usually used, these cannot protect against environmental influences. This also applies to the pawl interacting with the rotary latch. The invention aims to remedy this.

SUMMARY

The invention is based on the technical problem of further developing such a motor vehicle door lock so that the functioning is improved whilst providing a simpler and thus cheaper design compared to previous solutions.

In order to solve this technical problem, a generic motor vehicle door lock of the invention is characterised by the pawl being mounted inside the plastic housing and the rotary latch outside of the housing.

In the invention, the plastic housing thus acts as a main and supporting structural element and thus replaces the metal lock case and at least the bottom housing section or the housing shell combines these two structural elements. The plastic housing also acts as a bearing plate for the pawl as well as the rotary latch. As part of the invention, the pawl is mounted inside the housing whilst the rotary latch is mounted outside the housing.

The mounting of the rotary latch outside of the housing takes account of the fact that in this way the rotary latch can easily interact with the locking bolt. At the same time operational reliability is improved as only the rotary latch is arranged externally and thus subjected to moisture, dirt, etc., whilst the pawl is protected by being arranged and mounted inside the housing.

According to an advantageous embodiment, a locking arm of the pawl extends through an opening in the housing in order to interact with the rotary latch. The locking arm on the pawl is designed in such a way that it typically engages in a intermediate position recess or a fully-closed position recess of the rotary latch as soon as the rotary latch reaches the respective intermediate position or fully-closed position. The invention is based on the overall knowledge that this latching interaction between the pawl or its locking arm and the rotary latch only requires little movements of the pawl. As a result, the opening in the housing through which the locking arm of the pawl extends can be kept small and narrow and thus takes into account the minimal pivoting movements of the pawl.

This is added by the fact that the opening for the locking arm is designed as an opening slit with a slit width adapted to a material thickness of the pawl. The slit length of the opening slit is adjusted to the maximum travel of the pawl or of the locking arm in relation to the opening.

In general, the pawl is mounted on a pawl bearing pin formed on the housing, allowing it to pivot around a respective axis. The pawl bearing pin and the housing are usually produced as part of the same process. This can be a plastic injection-moulding and/or a metal die casting process. Basically, the pawl bearing pin can also contain an embedded reinforcement.

Generally, the pawl bearing pin is a hollow pin made of plastic. As the pawl bearing pin is arranged to form one pin with the housing, normally the same plastic is used to produce the housing and the pawl bearing pin. The pawl bearing pin can thus be particularly easily and inexpensively produced, i.e. in the same production step as the housing, using, for instance, said plastic injection moulding process. In other words, a separate pawl bearing pin made for instance of metal and its attachment on or in the housing is not required.

The rotary latch is generally arranged at the end of an inlet slot for the locking bolt. For this purpose, the rotary latch is in most cases arranged on a respective rotary latch bearing pin. This rotary latch bearing pin is advantageously seated in a hollow bore of the housing. This means that the hollow bore of the housing operates as a bearing bushing for the rotary latch bearing pin that typically consists of a steel pin, steel bolt or generally a metal bolt. For mounting, said rotary latch bearing pin only has to be inserted in the hollow bore in the housing and is either fixed or glued to it.

The basic design of the housing generally contains a base plate and a projection defining the inlet slot. This means that the projection protrudes in relation to the base plate, defining said inlet slot. The hollow bore accommodating the rotary latch bearing pin is located at the bottom or underneath the projections. The opening through which the locking arm of the pawl extends is provided on or below or generally in the area of the projection. In most cases, the opening is located below a longitudinal edge of the projection regularly having a prismatic or wedge shape. This is the pawl-sided longitudinal edge of the projection.

The projection actually extends wedge shaped in the direction of a transverse edge. The opposite side of the transverse edge is open, so that the locking bolt can enter the projection via this transverse edge. During this process, the locking bolt comes into contact with the opened rotary latch and moves it initially into the intermediate position and then into the fully-closed position. During this process, the locking arm on the pawl first engages in the intermediate position recess and then in the main catch recess.

The projection defining the inlet slot is formed on a rotary latch bearing surface. Compared to the pawl bearing surface, the rotary latch bearing surface is raised by an amount adapted to the material thickness of the pawl. This means that the pawl bearing surface defines a base plate of the housing. Compared to this base or the pawl bearing surface, the rotary latch bearing surface is raised or lowered when viewed from the top so that an edge is apparent in the area of the transition between the pawl bearing surface and the rotary latch bearing surface. This edge contains the opening slot for the locking arm of the pawl. Said edge is also located in the pawl-sided longitudinal edge of the projection.

Apart from the aforementioned housing, generally also a housing hood for closing off the housing is provided. In this case the housing, essentially accommodating the locking mechanism as well as other levers or other elements of the motor vehicle door lock also constitutes the bottom section of the housing. In contrast, the housing hood basically takes on the function of the top section of the housing. In this way only two structural elements are required for holding and storing all elements of the motor vehicle door lock of the invention, i.e. the housing and the housing hood closing off the housing. In principle it is also feasible to just work with a single structural element. The invention does, in any case, not require an additional lock case.

This considerably simplifies the design and produces significant cost savings. Also the weight of such a motor vehicle door lock of the invention compared to prior art embodiments is significantly lower, which in the light of constantly increasing vehicle weights is expressly welcomed and particularly advantageous. Furthermore, the inventive motor vehicle door lock or the housing as a main structural element can be produced particularly easily and comprehensively, i.e. generally as part of a (single) plastic injection moulding process. During this production process, additional elements previously manufactured separately are produced at the same time, such as at least the pawl bearing pin. In most cases this also includes the bearing bushing for the rotary latch bearing pin, also defined as part of the described production process, as the hollow bore, described already in detail. This leads to significant cost savings and also reduces the weight of the motor vehicle door lock significantly. These are the main advantages.

Below, the invention is explained in detail with reference to a drawing showing only one embodiment, in which:

DETAILED DESCRIPTION OF THE DRAWINGS

Figure 1:
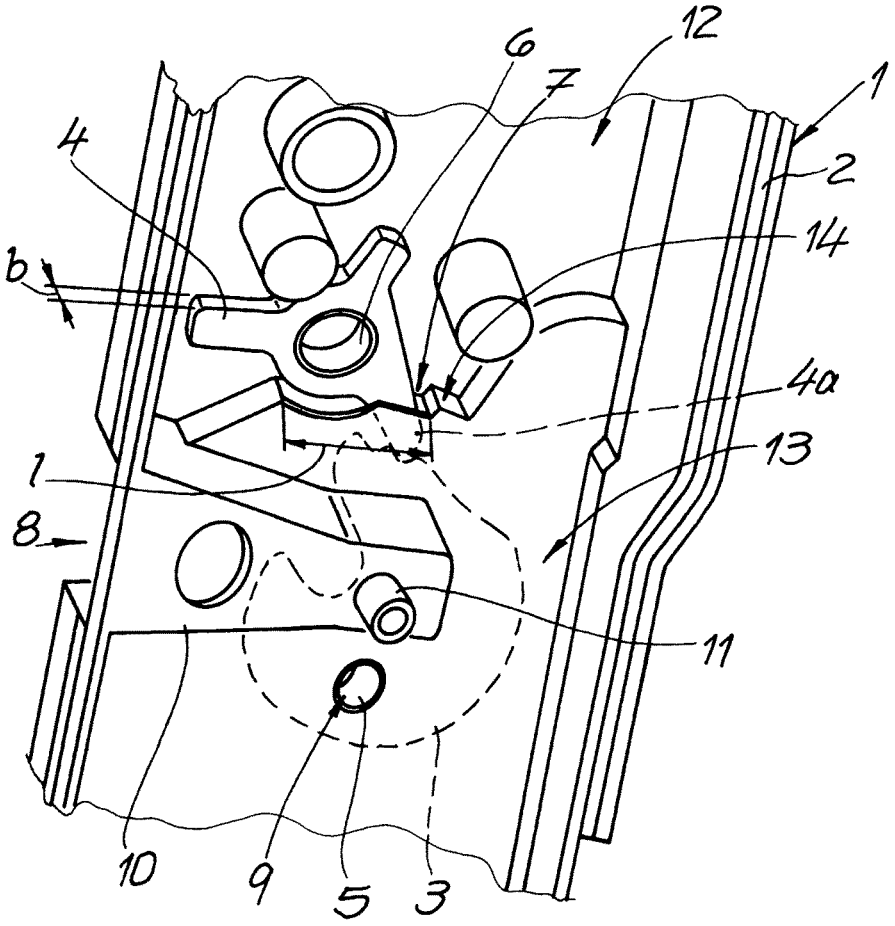
FIG. 1 shows the motor vehicle door lock of the invention with an integrated pawl and indicated rotary latch and FIG. 2 shows the object of FIG. 1 with the pawl removed.
Figure 2:
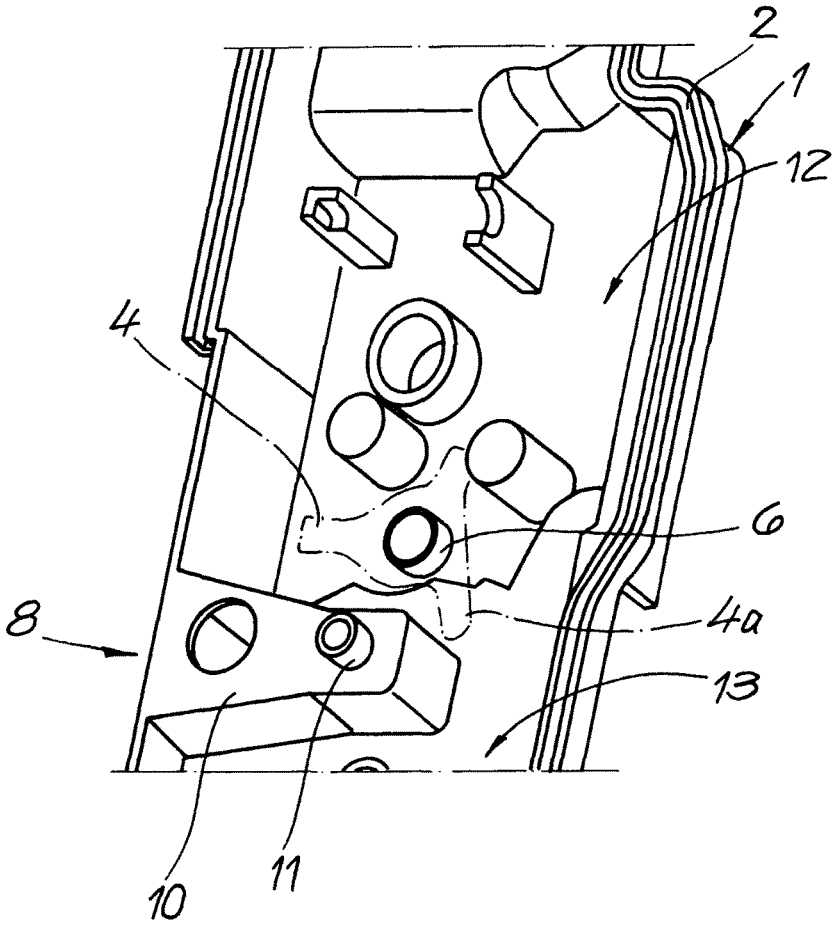

The figures show a motor vehicle door lock containing at least a housing 1, made of plastic. The example embodiment actually contains, apart from the housing 1 as the main structural element or as the bottom housing section, a housing hood—not shown—functioning as the top section of the housing. This housing hood can be incorporated in the housing 1 in a sealing manner and can for this purpose be, for instance, inserted in a groove 2. Alternatively, the groove 2 can also accommodate a seal 2, sealing a slit remaining between the housing 1 and the housing hood—not shown.

The basic design of the shown motor vehicle door lock provides apart from the at least one plastic housing 1 also a locking mechanism 3, 4, comprising substantially a rotary latch 3 and a pawl 4. Significant for the invention is the fact that the pawl 4 is mounted inside the housing 1 whilst the rotary latch 3 is mounted outside the housing 1. In detail, the rotary latch 3 is mounted on a rotary latch bearing pin 5. The pawl is mounted on a pawl bearing pin 6, designed in this case as a hollow bolt 6.

The pawl bearing pin 6 is formed on the housing 1 to form a single piece. The pawl bearing pin 6 and the housing 1 are actually produced in a common process, for instance a common plastic injection moulding process. For reasons of stability, the pawl bearing pin 6 can contain a reinforcement embedded in the plastic material. This is not shown in detail.

The pawl 4 contains a locking arm 4*a*, extending through an opening 7 in the housing 1 in order to interact with the rotary latch 3. It is apparent from the figures that the opening 7 is designed as an opening slit 7.

The opening slit 7 has a slit width adapted to the material thickness of the pawl 4. A slit length l of the opening or of the opening slit 7 takes into account the maximum pivoting movement of the locking arm 4*a* of the pawl 4 during intended use. During the closing process of the locking mechanism 3, 4 the pawl 4 is actually used to first engage in an intermediate position recess—not shown in detail—and then in a fully-closed position recess of the rotary latch 3, in order to retain the rotary latch 3 in the associated intermediate position or fully-closed position. As a result, the not expressly shown locking bolt, initiating this process, is also retained by the locking mechanism 3, 4. Conversely, the pawl 4 must be lifted off the rotary latch 3 so that the rotary latch 3 can open with the aid of a spring and release the locking bolt.

It is apparent that the rotary latch 3 is arranged at the end of an inlet slot 8. For this purpose, the rotary latch bearing pin 5 is accommodated in a hollow bore 9 of housing 1. This hollow bore 9 is located below a projection 10. The projection 10 also contains a journal 11 for accommodating further lock elements, not shown.

In detail, the housing 1 first of all contains a base plate 12, serving in the shown example also as a pawl bearing surface 12 or base surface. Apart from this base plate 12 or the base surface produced thereby or the created pawl bearing surface 12, the housing 1 also contains a rotary latch bearing surface 13. In relation to the pawl bearing surface, 12 the rotary latch bearing surface 13 is raised or lowered by an amount adapted to the material thickness b of the pawl 4 when viewed from the top. This means that the transition between the pawl bearing surface 12 and the rotary latch bearing surface 13 contains a projection or ledge 14, having a height that corresponds to the material thickness b of the pawl 4. This ledge 14 contains the opening or opening slit 7.

The projection 10 is arranged on the rotary latch bearing surface 13, which in turn is raised or lowered in relation to the pawl bearing surface 12 as described.

The projection 10 has an overall prismatic shape. The projection 10 tapers in wedge shape towards the rotary latch 3 or a transverse edge located at this point. The hollow bore 9 accommodating the rotary latch bearing pin 5 is actually arranged at the bottom or underneath the projections. The respective hollow bore 9 can thus be found at the bottom longitudinal edge of projection 10, having a trapezoidal cross section. The opening 7 for the pawl arm 4*a* is provided in the area of the upper longitudinal edge of projection 10 on the pawl side.

The transverse edge of the projection 11 on the inlet side is open, allowing the locking bolt to move over it into the inlet slot 8. The two longitudinal edges of the projection 10 are tapered in a wedge shape in order to move the locking bolt in the direction of the rotary latch 3.

The invention claimed is:

1. Motor vehicle door lock with at least one housing made of plastics material;

a locking mechanism comprising a rotary latch and a pawl;

the housing comprising:

an inner side;

an outer side;

a latch bearing surface having a latch side where the rotary latch is rotatable mounted;

a pawl bearing surface having a pawl side where the pawl is rotatable mounted, wherein the pawl side is part of the inner side of the housing and the latch side is part of the outer side of the housing;

a ledge that extends between the pawl bearing surface and the latch bearing surface between the rotary latch and pawl;

the pawl is arranged inside the housing and the rotary latch is arranged outside the housing.

2. Motor vehicle door lock according to claim 1, wherein a locking arm of the pawl extends through an opening in the housing to interact with the rotary latch.

3. Motor vehicle door lock according to claim 2, wherein the opening is designed as an opening slit with a slit width that is adapted to the material thickness of the pawl.

4. Motor vehicle door lock according to claim 1, wherein the pawl is mounted rotatably around a respective axis on a pawl bearing pin arranged on the housing to form a single piece.

5. Motor vehicle door lock according to claim 4, wherein the pawl bearing pin and the housing are produced in the same process, such as plastic injection moulding and/or metal die casting.

6. Motor vehicle door lock according to claim 1, wherein the rotary latch is arranged at the end of an inlet slot.

7. Motor vehicle door lock according to claim 1, wherein the rotary latch is mounted on a rotary latch bearing pin.

8. Motor vehicle door lock according to claim 7, wherein the rotary latch bearing pin is accommodated in a hollow bore of the housing.

9. Motor vehicle door lock according to claim 8, wherein the housing contains a base plate and a projection defining an inlet slot.

10. Motor vehicle door lock according to claim 9, wherein the hollow bore for accommodating the rotary latch bearing pin is arranged below the projection.

11. Motor vehicle door lock according to claim 10, wherein the opening through which the pawl extends, is arranged in the area of the projection.

12. Motor vehicle door lock according to claim 10, wherein the projection is wedge shaped.

13. Motor vehicle door lock according to claim 10, wherein the projection rises up from the latch bearing surface.

14. Motor vehicle door lock according to claim 13, wherein the latch bearing surface is raised by an amount adapted to the material thickness of the pawl in relation to the pawl bearing surface.

15. Motor vehicle door lock according to claim 1, wherein apart from the housing a housing hood closing off the housing is provided.

16. Motor vehicle door lock with at least one housing made of plastics material;

a locking mechanism comprising: a rotary latch and a pawl;

the housing comprising:

a latch bearing surface having a latch side where the rotary latch is rotatable mounted;

a pawl bearing surface having a pawl side where the pawl is rotatable mounted;

a ledge that extends between the pawl bearing surface and the latch bearing surface between the rotary latch and pawl, wherein the pawl side faces an opposite direction compared to the latch side, wherein the latch bearing surface is offset from the pawl bearing surface on the pawl side of the pawl bearing surface such that the latch bearing surface and the pawl bearing surface are not coplanar, and wherein the pawl is mounted inside the housing and the rotary latch is mounted outside the housing.

17. Motor vehicle door lock according to claim 16, wherein the latch bearing surface is offset from the pawl by an amount adapted to a material thickness of the pawl.

18. Motor vehicle door lock according to claim 16, wherein the ledge defines an opening, wherein a locking arm of the pawl extends through the opening to interact with the rotary latch.

19. Motor vehicle door lock according to claim 18, wherein the opening has a length adapted to accommodate a maximum pivoting movement of the locking arm to open and close the rotary latch.

* * * * *